US007731559B1

(12) United States Patent
Maddocks

(10) Patent No.: US 7,731,559 B1
(45) Date of Patent: Jun. 8, 2010

(54) TRANSMISSION OF VIBRATIONS TO A BODY CREATING REALISTIC SENSATIONS IN MECHANICAL TOYS

(75) Inventor: Richard J Maddocks, Barrington, RI (US)

(73) Assignee: Hasbro, Inc., Pawtucket, RI (US)

( * ) Notice: Subject to any disclaimer, the term of this patent is extended or adjusted under 35 U.S.C. 154(b) by 505 days.

(21) Appl. No.: 11/614,130

(22) Filed: Dec. 21, 2006

(51) Int. Cl.
*A63H 3/28* (2006.01)

(52) U.S. Cl. ..... 446/297; 446/295; 446/369

(58) Field of Classification Search ..... 446/268, 446/295, 297, 330, 369
See application file for complete search history.

(56) References Cited

U.S. PATENT DOCUMENTS

| | | | | | |
|---|---|---|---|---|---|
| 923,672 | A | * | 6/1909 | Leedy et al | 446/420 |
| 1,601,721 | A | * | 10/1926 | Colledanchise | 446/420 |
| 1,693,140 | A | * | 11/1928 | Dietze, Jr. | 446/420 |
| 2,410,646 | A | * | 11/1946 | Finn et al. | 446/272 |
| 2,618,377 | A | * | 11/1952 | May, Jr. | 198/766 |
| 3,064,389 | A | * | 11/1962 | Lemelson | 446/420 |
| 3,137,092 | A | * | 6/1964 | Salerno | 600/28 |
| 3,298,132 | A | | 1/1967 | Elwell | |
| 3,504,455 | A | | 4/1970 | Gardel et al. | |
| 3,619,936 | A | * | 11/1971 | Tauriello | 446/216 |
| 5,074,820 | A | | 12/1991 | Nakayama | |

* cited by examiner

*Primary Examiner*—John Ricci
(74) *Attorney, Agent, or Firm*—Perry Hoffman

(57) ABSTRACT

A realistic electro-mechanical toy that can simulate lifelike purring and other vibratory sensations of animals and other creatures by transmission of vibrations to the body of the mechanical toy providing enhanced and lifelike interaction with a user. An arm is coupled to a body and includes a finger portion at an end of the arm. The finger portion is biased against a cam which is rotatably coupled to the body and includes one or more protuberances on a surface perimeter such that when the cam is rotated a vibration is transmitted to the body simulating lifelike purring and other vibratory sensations. The cam is rotated in a back and forth motion and is synchronized with a sound element producing a purring sound occurring around the time the vibration is transmitted to the body.

30 Claims, 4 Drawing Sheets

TRANSMISSION OF VIBRATIONS TO A BODY CREATING REALISTIC SENSATIONS IN MECHANICAL TOYS

BACKGROUND OF THE INVENTION

1. Field of the Invention

The present invention relates to mechanical toys exhibiting realistic actions and functions. More particularly, the invention relates to a realistic electro-mechanical toy that can simulate lifelike purring and other vibratory sensations of animals and other creatures by transmission of vibrations to the body of the mechanical toy.

2. Description of the Related Art

In recent years, many sectors of the toy industry have responded to consumer demands for more realistic toys and games with enhanced capabilities by utilizing technological advancements to make toys and games more realistic and lifelike.

Consumer driven evolutions in the industry are found in toys embodied as creatures, animals, dolls and various other life forms real or imagined. For example, dolls can now speak, walk, and even roller skate, exhibiting movements and actions more realistic and lifelike than anyone could have imagined even ten years ago.

To provide a more realistic and interactive doll or toy, a cost-technology trade off becomes important. As is known, new technologies cannot typically be implemented to meet customer demands because of other constraints played on the industry by consumers. One of the most important constraints is cost. Therefore, even though technologies may exist to meet consumer demands, those technologies cannot be applied to this industry until they have adapted in such a way as to be more cost effective. To this end, the toy industry has employed relatively inexpensive motors and linkage assemblies to provide realistic mechanical dolls and toys. However, although such dolls may provide some realistic movable body parts, the dolls do not exhibit realistic sensations or functions which would provide an enhanced and lifelike interaction with a user.

An attempt to increase the realism of a doll or toys' functions focused on simulating a heartbeat, as seen in U.S. Pat. No. 3,298,132 to Elwell for "Heartbeat Simulating Mechanism for Dolls" issued Jan. 17, 1967, disclosing a mechanism for producing a pattern of intermittent vibratory sounds. Elwell discloses a radially extending disc carrying four radially projecting pairs of fingers mounted on an operating shaft and in contact with a rigid stud upstanding from a heart chamber. Upon rotation of the operating shaft, contact between the stud and each finger results in a visible shock wave extending over the heart chamber and producing simulated auricle and ventricle sounds.

The Elwell mechanism does not disclose an arm coupled to a body and biased against a cam including one or more protuberances on a surface perimeter, or alternatively, a cam including an elliptical surface perimeter. Elwell does not suggest a realistic electro-mechanical toy that can replicate lifelike purring and other vibratory sensations of animals and other creatures by transmission of vibrations to the body of the mechanical toy.

In view of the foregoing, a need exists for a mechanism to replicate lifelike vibratory sensations and functions of toys, animals and other creatures to provide an enhanced lifelike and realistic interaction with the user.

SUMMARY OF THE INVENTION

The present invention addresses shortcomings of the prior art to provide a realistic electro-mechanical toy that can simulate lifelike purring and other vibratory sensations of animals and other creatures providing an enhanced and lifelike interaction with a user. An arm is coupled to a body and includes a finger portion at an end of the arm. The finger portion is biased against a cam which is rotatably coupled to the body and includes one or more protuberances on a surface perimeter such that when the cam is rotated a vibration is transmitted to the body simulating lifelike purring and other vibratory sensations.

In one embodiment of the invention, the biasing means includes a spring coupled to the body maintaining the contact between the finger portion of the arm and the cam surface perimeter as the cam is rotated in a oscillating back and forth motion. Alternatively, in another embodiment, the cam includes an elliptical surface perimeter for engagement with the finger portion of the arm while the cam oscillates in a back and forth motion.

In another embodiment of the invention, a covering for the body in the form of an animated toy is provided. The covering lies adjacent the arm wherein the vibration is transmitted to the covering when the cam is rotated.

In another embodiment, the arm further includes an uneven surface to accentuate the vibration sensation transmitted to the body covering when the cam is rotated. The uneven surface of the arm includes one or more projections which emulate vertebrae, especially in a toy simulating an animal or other creature, furthering the vibration sensation felt on the body covering and providing an enhanced and lifelike interaction with the user.

In yet another embodiment of the invention, the back and forth oscillation of the cam is synchronized with a sound element producing a purring sound occurring around the time the vibration is transmitted to the body.

DETAILED DESCRIPTION OF THE EMBODIMENTS

Figure 1A:
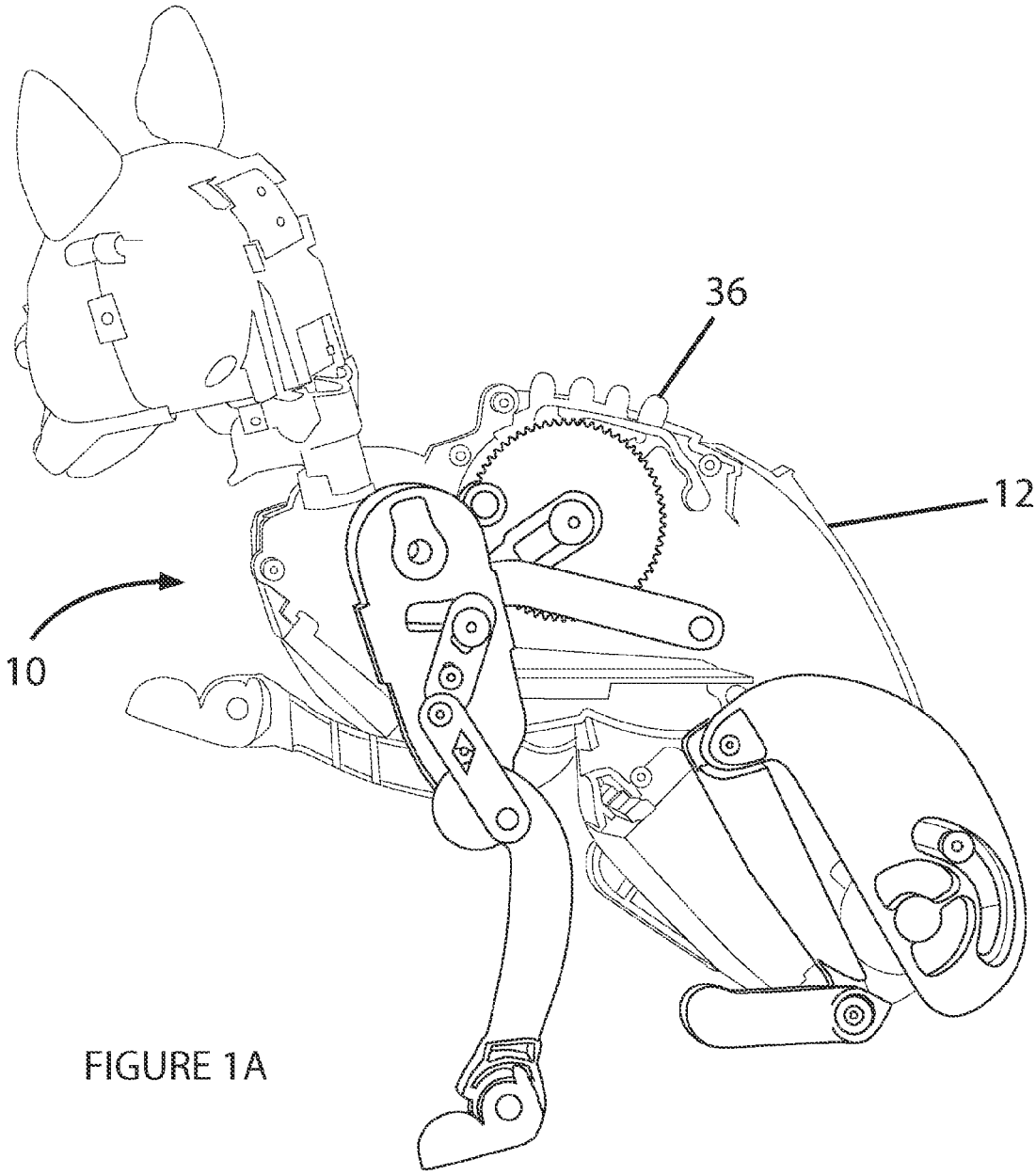
FIG. 1A is a perspective view of a toy embodying the present invention illustrating an arm including projections emulating vertebrae.

The following description is provided to enable those skilled in the art to make and use the described embodiment set forth in the best modes contemplated for carrying out the invention. Various modifications, however, will remain readily apparent to those skilled in the art. Any and all such modifications, equivalents, and alternatives are intended to fall within the spirit and scope of the present invention.

The present embodiment of the invention is an electro-mechanical toy providing lifelike purring and other vibratory sensations of animals and other creatures simulating realistic physiological functions and sensations. The toy of the present invention, generally shown in FIG. 1A as reference numeral 10, transmits vibrations to a body 12 creating realistic sensations and an enhanced and lifelike interaction with a user. The present embodiment is used in connection with the realistic coordinating of specific body part movements in mechanical toys as described in Applicant's Assignee's U.S. Provisional Application No. 60/740,613, filed on Nov. 29, 2005 and co-pending U.S. patent application Ser. No. 11/552,732 filed Oct. 25, 2006 for "Realistic Coordinating of Specific Body Part Movements in Mechanical Toys" which are incorporated herein by reference in their entirety. As described, the realistic electro-mechanical aspects herein facilitate simulation of lifelike purring and other vibratory sensations of animals and other creatures by transmission of vibrations to the body of mechanical animatronics providing enhanced and lifelike actions.

The body 12 of the present invention may look like a variety of animals, including bipeds and quadrupeds, as well as creatures real or imagined, and in an embodiment as seen in FIG. 1A, the body 12 takes on the shape of a cat. The body 12 may also include upper and lower body portions, as seen in FIG. 1A, or alternatively, body 12 may include more or less than two body portions. A variety of limb and limb portions may be coupled to the body 12, and as seen in FIG. 1A, the body 12 provides for the attachment of a pair of front limbs and a pair of rear or hind limbs. The toy 10 of the present invention provides for limbs which emulate a drop down or drooping leg positioning in what looks like a relaxed and non-flexing position when they are picked up from a supporting surface, mimicking what has been observed in real live animals.

Movement of the limb portions is driven by a motor 40 and directed by a drive assembly. The drive assembly includes a cam mechanism affixed to a drive shaft cooperating with one or more linkage assemblies positioned for engagement with one or more cam followers. Rotation of the drive shaft and affixed cam mechanism translates into movement of the limb and/or limb portions as well as simultaneous movement of the body portions. This drive assembly may also simultaneously drive the production of vibrations transmitted to the body 12 to simulate lifelike purring and other vibratory sensations, or alternatively, a second drive assembly cooperating with a second drive shaft may be included.

Figure 1B:
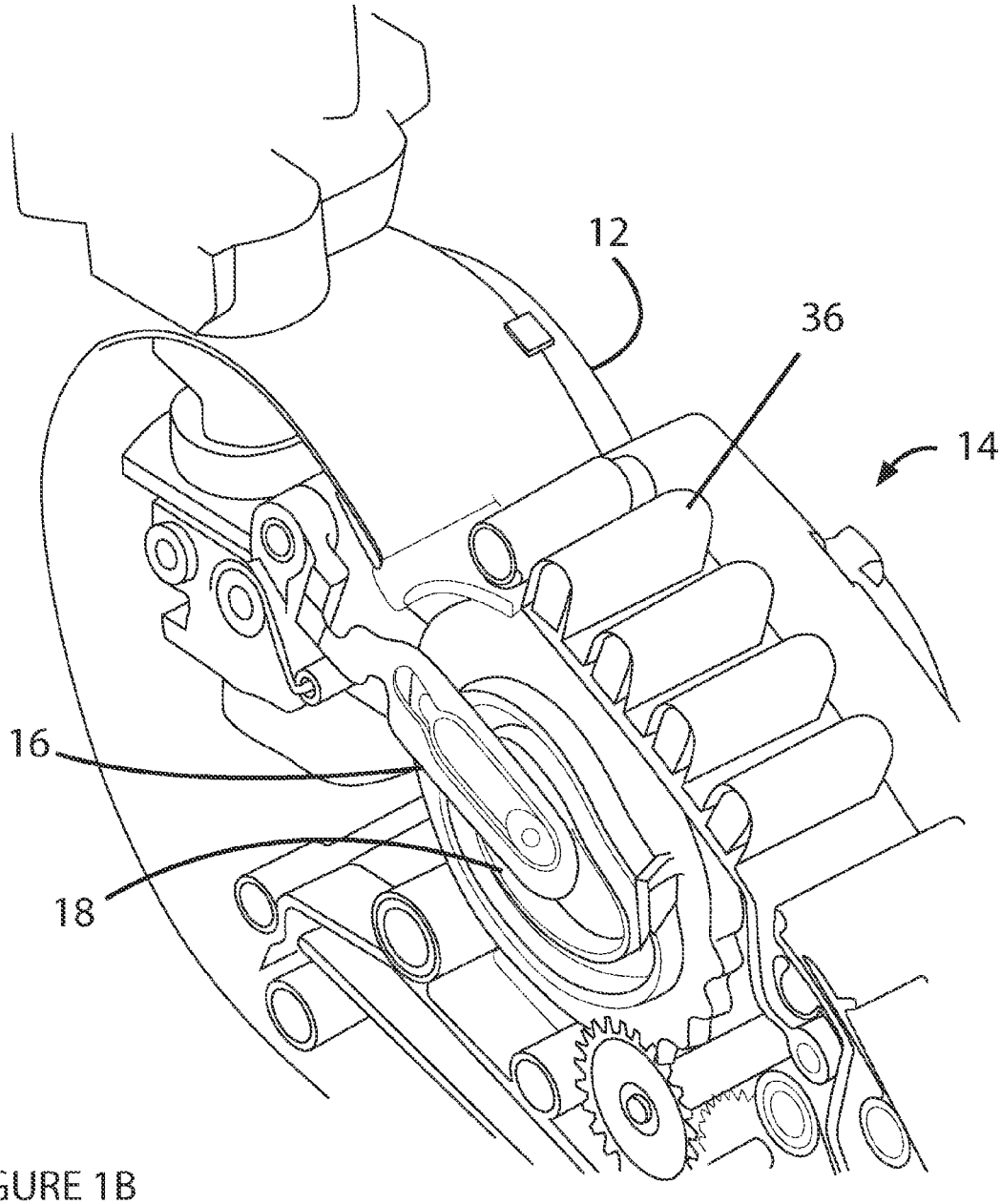
FIG. 1B illustrates the arm coupled to a body and cooperating with a cam.
Figure 1C:
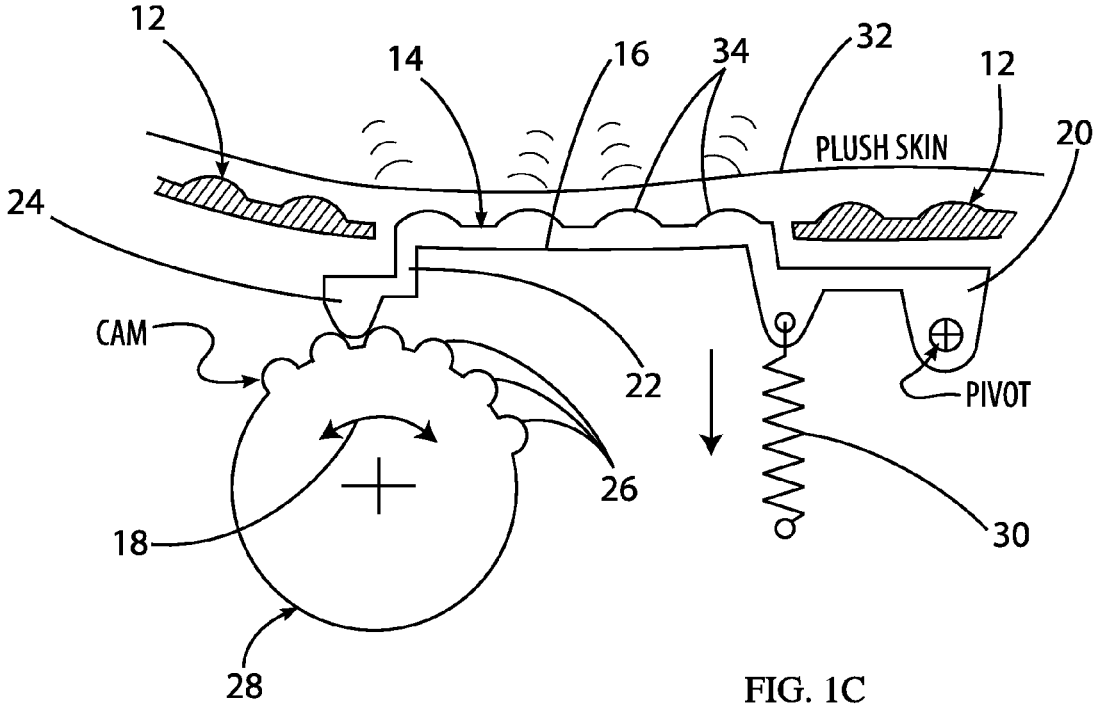
FIG. 1C illustrates a finger portion of the biased arm contacting protuberances of the cam, and alternately
Figure 1D:
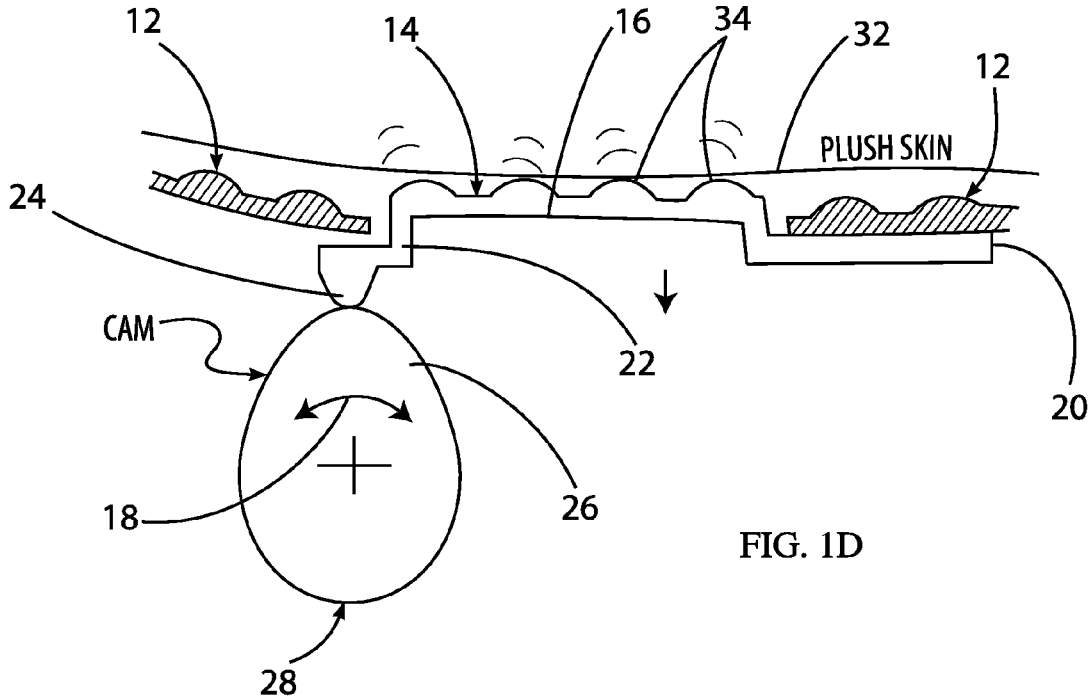
FIG. 1D illustrates a finger portion of the biased arm having a rigid connection to the body of the toy where an illustrated cam has an elliptical surface perimeter for engagement with the finger portion.

A vibratory assembly 14 for transmitting vibrations to the body 12 is coupled to and may be contained at least partially within the body 12. The vibratory assembly 14 includes an arm 16 and a cam 18, as seen in FIGS. 1B and 1C. The arm 16 is generally elongated and manufactured from any material suitable for maintaining its integrity while in use, yet flexible enough to transmit a vibration to the body 12. As seen in FIG. 1C, the arm 16 includes a first end 20 and a second end 22 and is pivotably coupled to the body 12 at the first end 20. Alternately, a rigid connection to the body 12 may be used for coupling the first end 20 rather than being provided as a pivot (See, FIG. 1D). With the rigid connection, the arm 16 is rigidly coupled at the first end 20 to the body 12 to enhance the degree of vibration for transmission to the larger shell of the body 12 depending on the properties and dimensions of the molded material. Also attached at the second end 22 is a finger portion 24 designed for engagement with the cam 18. As seen in FIG. 1C, the finger portion 24 has a somewhat V or funnel shape but alternatively the finger portion 24 can take on any variety of shapes or designs suitable for engagement with the cam 18.

Cam 18, as seen in FIGS. 1B and 1C, is rotatably coupled to the body 12 and is positioned for engagement with the finger portion 24 of the arm 16. The cam 18 may be a variety of shapes and thickness, and as seen in FIGS. 1C and 1B, cam 18 is generally round and includes a thickness suitable for engagement with finger portion 24. Cam 18 also includes one or more protuberances 26 on a surface perimeter 28, and as seen in FIG. 1C, cam 18 includes numerous protuberances 26 adjacent each other on a portion of the surface perimeter 28. Alternatively, Cam 18 may include an elliptical surface perimeter, or another non-circular surface perimeter, for engagement with the finger portion 24 with or without including protuberances or projections from the cam surface perimeter (See, FIG. 1D).

A biasing means is coupled to the arm 16 for keeping the finger portion 24 in contact with the cam 18 when the cam is rotated. As seen in FIG. 1C, the biasing means includes a spring 30 coupled from the arm 16 to the body 12, or alternatively, the biasing means can include any means known in the art, such as a magnetic biasing means, etc., for keeping the finger portion 24 in contact with one or more protuberances of the cam surface perimeter 28 when the cam is rotated.

Cam 18 is driven for rotation by the motor 40 and directed by the drive assembly, as discussed above. Cam 18 is a affixed to and rotated by the drive shaft as discussed above, or alternatively, cam 18 is affixed to and rotated by a second drive shaft. When cam 18 is rotated it oscillates in a back and forth direction, as shown in FIG. 1C, and the biased finger portion 24 is bounced up and down as it travels across the cam protuberances 26 transmitting a vibratory wave along the arm 16 spreading to the body 12 to simulate lifelike purring and other vibratory sensations.

A covering 32 for the body 12 is shown in FIG. 1C, and can include a plush, furry or hairless skin. The covering 32 may be provided for in the form of an animated toy covering the entire body 12, or alternatively a portion of the body 12. The covering 32 lies adjacent the arm 16, as seen in FIG. 1C, such that the vibration emitting from the arm 16 is transmitted to the covering 32 when the cam is rotated.

The arm 16 also includes an uneven or bumpy surface 34 lying adjacent the covering 32, as seen in FIG. 1C, to accentuate the vibration sensation felt on the body covering 32. The uneven surface 34 can also include one or more projections 36 emulating vertebrae for an animated toy, as seen in FIGS. 1A and 1B. These vertebrae projections 36 also accentuate the vibration sensation felt on the body covering 32, and also provide a lifelike look to the animated toy, further enhancing the realistic interaction the toy of the present invention has with the user.

Figure 2:
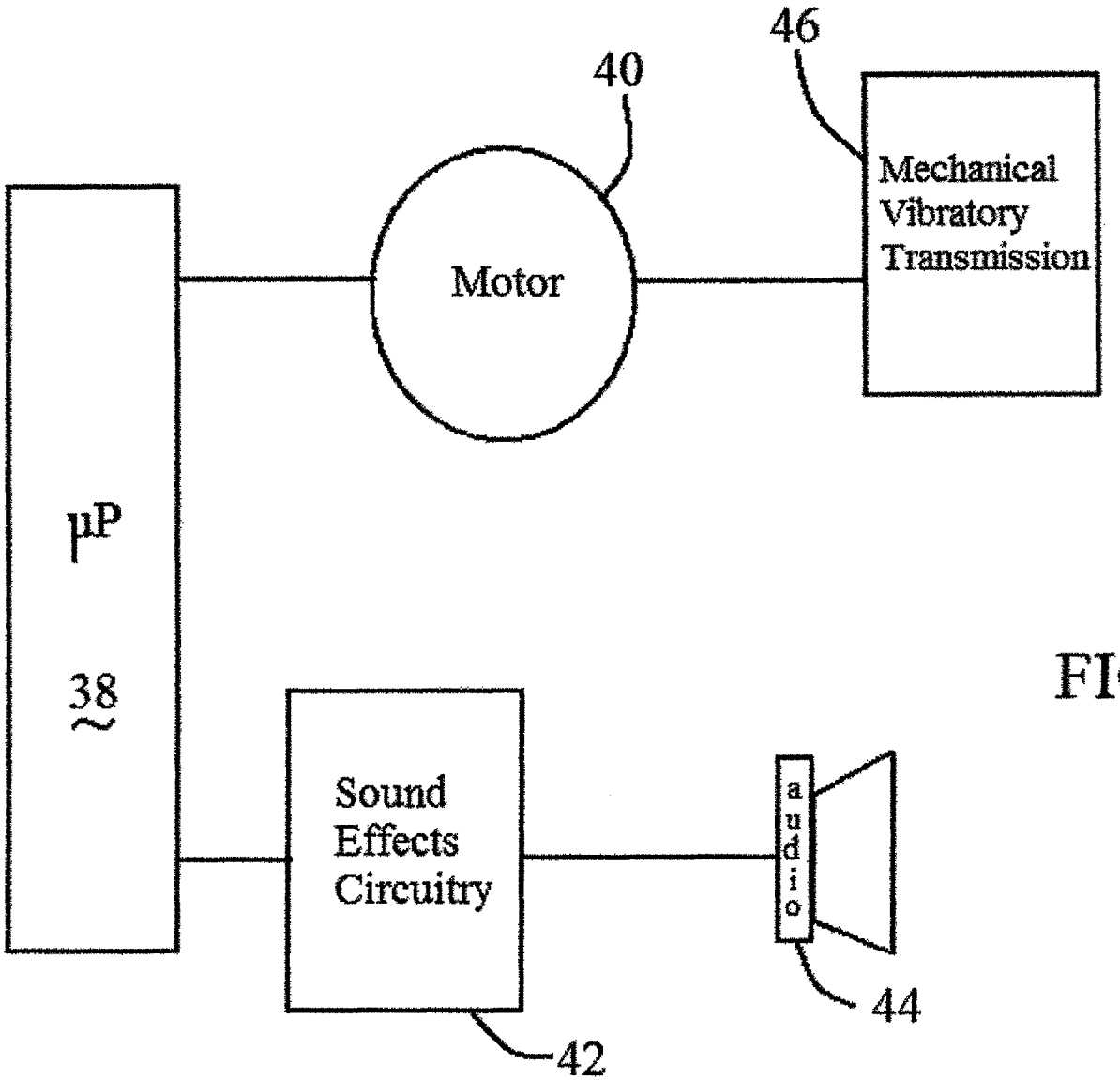
FIG. 2 is a schematic illustrating circuitry for synchronization of mechanical vibratory transmissions with sound effects electronic circuitry.

As shown in FIG. 2, the transmission of vibrations to the body 12 is controlled by a microprocessor 38 which may be provided as a conventional microprocessor or microcontroller as electronic control circuitry that controls the described mechanical transmission of vibrations as well as other movements, functions, and sensory input and output, etc. of the toy 10 of the present invention. In the present described embodiment, the microprocessor 38 synchronizes the motor 40 driven oscillation of the cam 18 with sound effects circuitry 42 to produce a purring sound emitting from the audio speaker 44 occurring around the same time the mechanical vibration 46 is transmitted to the body 12. The purring sound combined to occur simultaneously with the vibratory sensations felt in the body 12 provides for an enhanced realistic and lifelike interaction experienced by the user.

The mechanical vibratory sensations 46 transmitted to the body 12 also produces a purring-like vibratory sound even without activation of the sound effects circuitry 42, and likewise the production of purring sounds from the sound effects circuitry 42 also produces a vibratory sensation felt in the body 12 even without activation of the mechanical vibratory transmissions 46. The microprocessor 38 can coordinate the two sensations to supplement each other by activating the mechanical vibratory transmissions 46 and sound effects circuitry 42 simultaneously, or alternatively coordinate the two sensations to activate independently and occur consecutively, or at completely separate times, or any combination thereof.

For example, the microprocessor 38 can coordinate the production of purring sounds from the sound effects circuitry 42 to supplement the vibratory sounds which accompany the mechanical transmission of vibratory sensations 46 felt in the body 12 of the present described embodiment, or not supplement the mechanical vibratory transmissions 46. Likewise, the microprocessor 38 can coordinate the production mechanical vibratory sensations 46 to supplement the vibratory sensations felt in the body 12 which accompany the production of purring sounds from the sound effects circuitry 42 of the present described embodiment, or not supplement the sound effects circuitry 42.

It should be appreciated that a wide range of changes and modifications may be made to the embodiments of the inventions as described herein. It is intended that the foregoing detailed description be regarded as illustrative rather than limiting. While there have been illustrated and described particular embodiments of the inventions, it will be appreciated that numerous changes and modifications will occur to those skilled in the art, and it is intended in the appended claims to cover those changes and modifications which fall within the true spirit and scope of the present invention.

What is claimed is:

1. An apparatus for transmitting a vibration to a body, comprising:

an arm coupled at a first end to a body and including a finger portion at a second end;

a cam rotatably coupled to the body and in biased engagement with the finger portion of the arm, the cam including one or more protuberances on a surface perimeter for engagement with the finger portion;

a sound element having sound effects circuitry with an audio speaker for producing sounds emitted from the audio speaker; and wherein vibrations are transmitted to the body as the finger portion contacts one or more protuberances when the cam oscillates to synchronize with the sounds emitted from said sound element occurring with the vibrations transmitted to the body as the cam is rotated.

2. The apparatus according to claim 1, comprising a spring coupled for maintaining the cam in biased engagement with the finger portion of the arm.

3. The apparatus according to claim 1, wherein the arm is pivotably coupled at a first end to a body.

4. The apparatus according to claim 1, wherein the arm is rigidly coupled at a first end to a body.

5. The apparatus according to claim 1, wherein the back and forth oscillation of the cam is synchronized with the sound element for producing a purring sound occurring around the time the vibration is transmitted to the body.

6. The apparatus according to claim 1, further comprising a covering for an animated toy laying adjacent the arm wherein the vibration is transmitted to the covering when the cam is rotated.

7. The apparatus according to claim 6, wherein the arm includes an uneven surface to accentuate the vibration sensation felt on the body covering when the cam is rotated.

8. The apparatus according to claim 7, wherein the uneven surface of the arm includes one or more projections emulating vertebrae for an animated toy.

9. An apparatus for transmitting a vibration to a body, comprising:

an arm coupled at a first end to a body and including a finger portion at a second end;

a cam rotatably coupled to the body and in biased engagement with the finger portion of the arm, the cam including one or more protuberances on a surface perimeter for engagement with the finger portion;

a sound element having sound effects circuitry with an audio speaker for producing sounds emitted from the audio speaker; and wherein vibrations are transmitted to the body as the finger portion contacts one or more protuberances when the cam is rotated and wherein the cam oscillates back and forth when rotated, with the sound element producing sounds emitted from the audio speaker occurring around the time the vibration is transmitted to the body.

10. The apparatus according to claim 9, comprising a spring coupled for maintaining the cam in biased engagement with the finger portion of the arm.

11. The apparatus according to claim 9, wherein the arm is pivotably coupled at a first end to a body.

12. The apparatus according to claim 9, wherein the arm is rigidly coupled at a first end to a body.

13. The apparatus according to claim 9, wherein the back and forth oscillation of the cam is synchronized with the sound element and wherein the sound element produces a purring sound occurring around the time the vibration is transmitted to the body.

14. An apparatus for transmitting a vibration to a body, comprising:

an arm coupled at a first end to a body and including a finger portion at a second end;

a cam rotatably coupled to the body and in biased engagement with the finger portion of the arm, the cam including one or more protuberances on a surface perimeter for engagement with the finger portion wherein vibrations are transmitted to the body as the finger portion contacts one or more protuberances when the cam is rotated; and a covering for an animated toy laying adjacent the arm wherein the vibration is transmitted to the covering when the cam is rotated.

15. The apparatus according to claim 14, wherein the arm includes an uneven surface to accentuate the vibration sensation felt on the body covering when the cam is rotated.

16. The apparatus according to claim 15, wherein the uneven surface of the arm includes one or more projections emulating vertebrae for an animated toy.

17. The apparatus according to claim 14, comprising a spring coupled for maintaining the cam in biased engagement with the finger portion of the arm.

18. The apparatus according to claim 14, wherein the arm is pivotably coupled at a first end to a body.

19. The apparatus according to claim 14, wherein the arm is rigidly coupled at a first end to a body.

20. An apparatus for transmitting a vibration to a body, comprising an arm coupled at a first end to a body and including a finger portion at a second end;

a cam rotatably coupled to the body and in biased engagement with the finger portion of the arm, the cam including an elliptical surface perimeter for engagement with the finger portion; and wherein vibrations are transmitted to the body as the finger portion contacts the elliptical cam surface perimeter transmitting a vibration to the body when the cam is rotated.

21. The apparatus according to claim 20, comprising a spring coupled for maintaining the cam in biased engagement with the finger portion of the arm.

22. The apparatus according to claim 20, wherein the cam oscillates back and forth when rotated.

23. The apparatus according to claim 22, wherein the back and forth oscillation of the cam is synchronized with a sound element producing a purring sound occurring around the time the vibration is transmitted to the body.

24. The apparatus according to claim 20, further comprising a covering for an animated toy laying adjacent the arm wherein the vibration is transmitted to the covering when the cam is rotated.

25. The apparatus according to claim 24, wherein the arm includes an uneven surface to accentuate the vibration sensation felt on the body covering when the cam is rotated.

26. An apparatus for transmitting a vibration to a body covering of an animated toy, comprising:

an arm pivotably coupled at a first end to a body and including a finger portion at a second end;

a covering laying adjacent an uneven surface of the arm;

a cam rotatably coupled to the body and including one or more protuberances on a surface perimeter for engagement with the finger portion of the arm; and a biasing spring coupled to the arm for keeping the finger portion in contact with the cam surface;

wherein the spring biased finger portion contacts said one or more protuberances when the cam is rotated transmitting a vibration to the body covering.

27. The apparatus according to claim 26, wherein the cam oscillates back and forth when rotated.

28. The apparatus according to claim 27, wherein the back and forth oscillation of the cam is synchronized with a sound element producing a purring sound occurring around the time the vibration is transmitted to the body.

29. The apparatus according to claim 26, wherein the arm includes an uneven surface to accentuate the vibration sensation felt on the body covering when the cam is rotated.

30. The apparatus according to claim 29, wherein the uneven surface of the arm includes one or more projections emulating vertebrae for an animated toy.

* * * * *